US010883681B2

(12) United States Patent
Castro

(10) Patent No.: US 10,883,681 B2
(45) Date of Patent: Jan. 5, 2021

(54) APPARATUS FOR SUSPENDING DECORATIVE PENDANT LIGHTS

(71) Applicant: Rose M. Castro, Westbury, NY (US)

(72) Inventor: Rose M. Castro, Westbury, NY (US)

( * ) Notice: Subject to any disclaimer, the term of this patent is extended or adjusted under 35 U.S.C. 154(b) by 0 days.

(21) Appl. No.: 16/552,657

(22) Filed: Aug. 27, 2019

(65) Prior Publication Data

US 2019/0383452 A1 Dec. 19, 2019

Related U.S. Application Data

(63) Continuation-in-part of application No. 15/815,175, filed on Nov. 16, 2017, now abandoned.

(51) Int. Cl.

| | |
|---|---|
| ***F21S 4/00*** | (2016.01) |
| ***F21V 21/00*** | (2006.01) |
| ***F21S 8/00*** | (2006.01) |
| ***F21V 15/015*** | (2006.01) |
| ***F21V 23/00*** | (2015.01) |
| ***F21V 21/08*** | (2006.01) |
| ***F21V 17/16*** | (2006.01) |
| ***F21V 23/06*** | (2006.01) |

(Continued)

(52) U.S. Cl.

CPC ..... *F21S 8/033* (2013.01); *F21V 15/015* (2013.01); *F21V 17/16* (2013.01); *F21V 21/0808* (2013.01); *F21V 23/002* (2013.01); *F21V 23/06* (2013.01); *F21W 2121/00* (2013.01); *F21Y 2103/00* (2013.01)

(58) Field of Classification Search

CPC ..... F21S 4/00; F21S 4/10; F21S 8/026; F21S 8/033; F21S 8/035; F21V 17/00; F21V 21/08; F21V 21/088; F21V 17/06; F21V 15/01; F21V 17/007; F21V 17/002; F21V 17/12; F21V 21/005; F21V 21/096; F21V 21/32; F21V 23/00; F21V 17/105; F21V 17/14; F21V 21/04; F21V 21/14; F21V 21/30; F21V 23/006; F21V 23/02; F21V 23/0407; F21V 23/0442; F21V 21/02; F21V 21/03; F21V 21/048; F21V 21/06; F21V 21/0832; F21V 23/002; F21V 23/026; F21V 23/0435; F21V 23/0464; F21V 23/0471; F21W 2121/00; F21W 2121/04; F21W 2121/004

See application file for complete search history.

(56) References Cited

U.S. PATENT DOCUMENTS 5,707,136 A * 1/1998 Byers ..... F21V 3/02 362/145

6,186,644 B1 * 2/2001 Mosseau ..... F21V 17/007 362/125

(Continued)

*Primary Examiner* — Thien T Mai

(74) *Attorney, Agent, or Firm* — Allen R. Morganstern; Alfred M. Walker

(57) ABSTRACT

The present disclosure discloses an apparatus for suspending decorative lights. The apparatus comprises an elongated tube structure that can be coupled to a window, door or other fixtures in a building with one or more removable pivoting connector mounts. The elongated tube structure comprises individual lights or a net of lights. The lights are coupled to the elongated tube structure via openings provided in the elongated tube structure. The elongated tube structure comprises a wire within the structure to draw power for lighting the lights.

20 Claims, 10 Drawing Sheets

(51) Int. Cl.
*F21Y 103/00* (2016.01)
*F21W 121/00* (2006.01)

(56) References Cited

U.S. PATENT DOCUMENTS 6,341,875 B1 * 1/2002 Chu ..... F21V 19/006
362/249.06
6,659,622 B2 * 12/2003 Katogi ..... F21V 21/005
362/219
6,702,453 B2 * 3/2004 Weedon ..... F21S 2/00
362/219
7,066,618 B1 * 6/2006 Little ..... F21V 21/08
248/227.4
7,401,946 B2 * 7/2008 Laukhuf ..... F21S 4/28
362/219
2008/0094848 A1 * 4/2008 Inagaki ..... F21K 9/00
362/362

* cited by examiner

APPARATUS FOR SUSPENDING DECORATIVE PENDANT LIGHTS

RELATED APPLICATIONS

The present application is a continuation-in-part of, and claims priority in part under 35 U.S.C. § 120 from, application Ser. No. 15/815,175, which '175 application was filed on Nov. 16, 2017. The '175 application is incorporated by reference herein.

FIELD OF THE INVENTION

The present disclosure relates to an apparatus for suspending lights, more particularly, the present disclosures relates to the apparatus for suspending lights for decoration purpose on buildings.

DESCRIPTION OF THE RELATED ART

It is known that decorative lights are used for decoration purpose on buildings for many reasons. For example, the decorative lights are used to decorate the buildings during the Christmas season. At the time of unpacking or packing the decorative lights, one must be careful as the decorative lights may get tangled. If the decorative lights get tangled, then it is time consuming to untangle the decorative lights. Further, some of the decorative lights may get damaged. In another example, bulbs may get damaged due to fluctuation in voltage or physical environment and so on when the decorative lights after installing on the building. In such a case, one must climb a ladder to fix or to replace the bulbs.

In order to overcome the problems of tangling and replacing the bulbs without much difficulty, several designs have been proposed in the existing art. One such design is disclosed in U.S. Pat. No. 6,846,092 of Taylor. In '092 of Taylor, an elongated storage unit having an opening at bottom surface is disclosed. The elongated storage unit is used to removably couple a light-emitting assembly, i.e., decorative lights. In order to put the decorative lights, user may couple the light-emitting assembly to the elongated storage unit thereby allowing the user to easily and quickly decorate the building with the decorative lights.

It should be understood that the above design has several problems. The decorative lights when suspended from the elongated storage unit may get tangled. Further, it is difficult to fit the elongated storage unit to different structures such as doors, walls in the buildings.

U.S. Pat. No. 8,079,739 B2 of Cooper discloses an Interlocking System for Hanging Decorative Lights and Fixtures in an elongated lighting bar with lights descending downward therefrom, where the elongated bar has internal electrical wiring and distal end, which can mate with corresponding distal ends of an adjacent elongated lighting bar, to lengthen the length of the combined elongated lighting bars. However, Cooper '739 shows permanent wall attached brackets in FIGS. 6 to 9, except for FIG. 8, which shows a "U-shaped" clip 804 to be used to attach the bracket to an outdoor roof gutter. Other than FIG. 8 of Cooper '739, which needs a vertically extending member to drape over, the brackets of FIGS. 6, 7 and 9 of Cooper '739 appear to need screws or other permanent mounting fasteners.

Other documents describing the closest subject matter provide for a number of more or less complicated features that fail to solve the problem in an efficient and economical way. None of these patents suggest the novel features of the present invention.

OBJECTS OF THE INVENTION

It is one of the main objects of the present invention to provide an apparatus for suspending lights for decoration purpose on buildings.

It is one object of present invention to provide an apparatus comprising an elongated tube structure. The apparatus comprises at least one light suspending from the elongated tube structure. The elongated tube structure comprises a wire to draw current from a power source.

It is one object of present invention to provide a flexible or moldable elongated tube structure such that the elongated tube structure is adhesively but removably fitted to a glass window pane, window frame, door or any structure in a building. It is another object of present invention to easily attach or detach the at least one light to the elongated tube structure.

It is another object of present invention to attach two or more lights in series, i.e., as a net of lights and in parallel with varied height, length, width and color.

It is yet another object of present invention to make decorating lights easy, and storing the lights without tangling, Further objects of the invention will be brought out in the following part of the specification, wherein detailed description is for the purpose of fully disclosing the invention without placing limitations thereon.

SUMMARY OF THE INVENTION

The present invention is an apparatus for suspending decorative pendant lights upon a window pane, window frame, door or wall. Preferably, an elongated tube structure used is supported at each end by an apparatus that attaches it to an existing surface or object; this mounting structure is the subject of the instant invention.

Since the suspending lights may be used only seasonally, the mounting is not permanent. It is desirable that no tools be required for mounting a lighting tube and that no nail or screw holes, marks, or sticky adhesive residue are left at the site when a mount is removed. Convenience and ease of use are of paramount importance.

3M® Corporation developed and currently markets a line of COMMAND™ brand adhesive mounting strips and associated clips and hooks. The strips are designed with integral release liners on both front and back surfaces. They are available in a variety of sizes for suspending picture frames or decorations. These strips are ideal for attaching the mount of this invention to the desired supporting structure such as a wall or window pane. With the introduction of COMMAND OUTDOOR CLIPS™, 3M® Corporation reveals an outdoor version of their removable strip adhesive which is also usable at a wider temperature range, water resistant, and UV resistant. Each mounting strip has a release tab sticking out of one end; just pull it to remove the strip from both supporting structure and the object itself without leaving any mark or smudge.

The mount of this invention is comprised of two separate parts, a mounting plate and a tube clip. The mounting plate is a flat preferably square plate with a central region formed on the front surface into a socket by virtue of four low walls defining a square box open at the top. The tube clip is preferably cubic in shape with the addition of a pair of springy clamping arms sized to grasp the outside diameter of an elongated tube for suspending lights. Two faces of the tube clip, one below the clamping arms, and one 90 degrees away adjacent the clamping arms, fit into the socket of the mounting plate. Latch features keep the tube clip attached to the mounting plate until pulled out with some force. The assembled mount supports one end of the elongated tube. The mount itself is attached to a supporting structure using a pair of 3M COMMAND® mounting strips attached to the back surface of mounting plate. It is noted that the mount can attach a lighting tube to surfaces which are 90 degrees apart such as a window pane and an inner window frame by selecting the appropriate orientation for engaging the tube clip with the socket of the mounting plate.

For example, in one orientation, an elongated light tube with lamps and a power cord is attached to a glass window pane by one mount near each end. The number of mounts can be as few as a single, centrally located mount, or a plurality of spaced apart mounts in excess of a pair of mounts. The lighting tube can also be attached at a ninety degree orientation from that of the window pane, where the lighting tube is attached to the vertically extending planks of the side members of the window frame, at a different orientation than when attached to a glass window pane.

In another mounting clip embodiment, two pivoted parts are provided attachable to a mounting plate. The base plate can be rotated 90 degrees when changing from mounting the lighting tube from the glass window pane to the side window frame. Once an elongated lighting tube is grasped by a spring clip, it is prevented from further rotation.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an apparatus for suspending decorative lights. The apparatus comprises an elongated tube structure that can be coupled to a window, door or other fixtures in a building. The elongated tube structure comprises individual lights or a net of lights. The decorative lights may be coupled to the elongated tube structure via openings provided in the elongated tube structure or using claw structure provided on the elongated tube structure. The elongated tube structure comprises a wire within to draw power. The wire may be coupled to decorative lights for supplying current.

Various features and embodiments of the apparatus for suspending decorative lights are explained in conjunction with the description of FIGS. 1-4.

Figure 1:
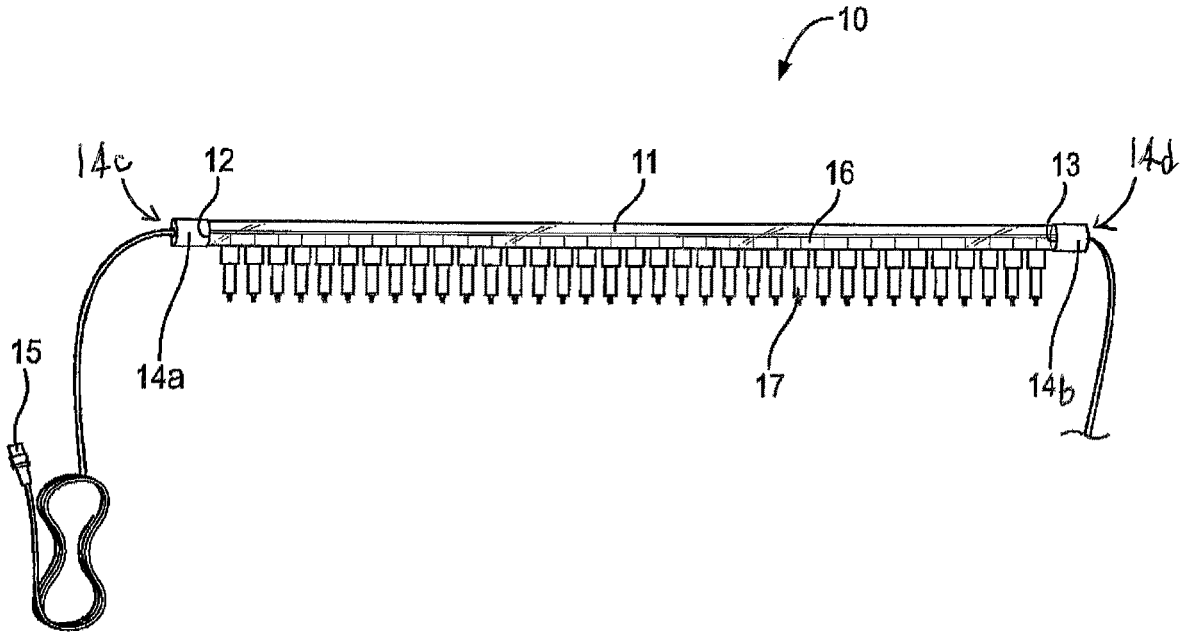
FIG. 1 illustrates a front view of an apparatus for suspending decorative lights, in accordance with one embodiment of the present disclosure.

Referring to FIG. 1, an apparatus 10 for suspending decorative lights is shown. The apparatus 10 comprises an elongated tube structure 11. In one example, the elongated tube structure 11 may be made up of a transparent material. In another example, the elongated tube structure 11 may be made up of a translucent or an opaque material. Further, the elongated tube structure 11 may be made up of a flexible material. The elongated tube structure 11 comprises a first end 12 and a second end 13. In one example, the first end 12 is coupled to a first end cap 14*a* having a connector 14*c* therein. Further, the second end 13 is coupled to a second end cap 14*b* having a second connector 14*d* therein. In one example, either the first end cap 14*a* or the second end cap 14*b* is removed to extend the length of the apparatus 10. In order to increase the length of the apparatus 10, a user may unscrew the first end cap 14*a* and connect additional elongated tube structure to the elongated tube structure 11 by a connector 14*c* therein connectable to a second connector 14*d* of an adjacent second tube structure 11 being connected to the elongated tube structure 11.

Figure 2A:
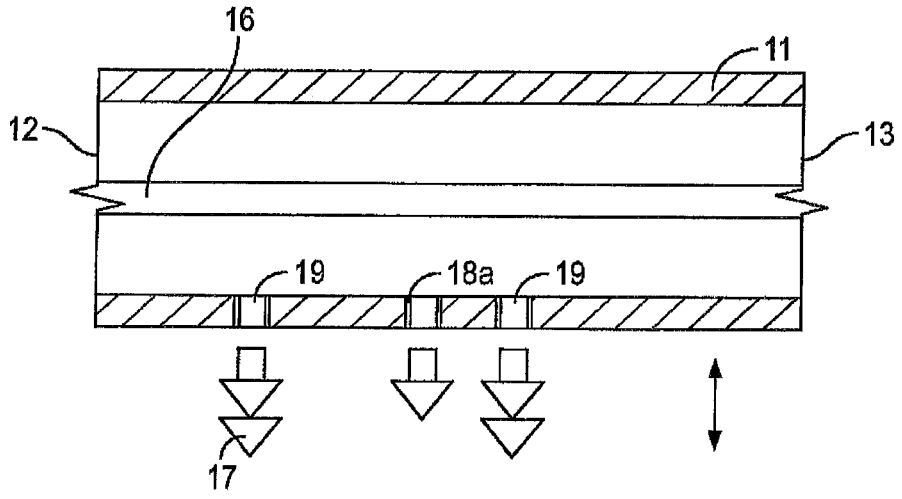
FIGS. 2A and 2B illustrate a cross-sectional view of an elongated tube structure, in accordance with one embodiment of the present disclosure.
Figure 2B:
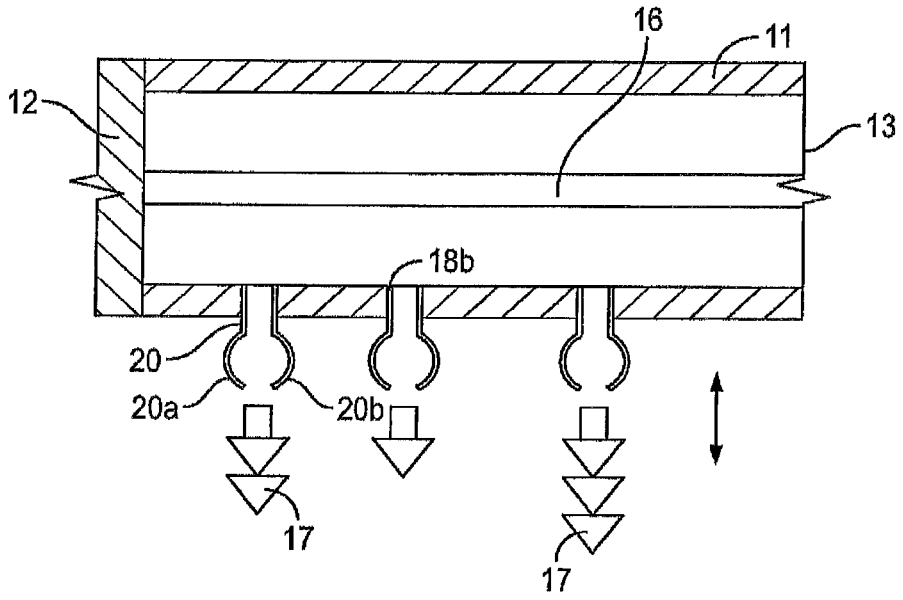

In one implementation, the elongated tube structure 11 comprises an insulated two conductor wire 16 drawn through therein. The wire 16 is retractable within the inner surface of the elongated tube structure 11. Specifically, the wire 16 is drawn through the first connector 14*c* under first end cap 14*a*, inner portion of the elongated tube structure 11, and through the second connector 14*d* under end cap 14*b*. The wire 16 may comprise a plug 15 at one end, which can be used to connect to a power source (not shown) to draw electricity. Further, the elongated tube structure 11 comprises a plurality of light members 17. The plurality of light members 17 may be provided as a single light or in a net of lights or a series of lights as shown in FIG. 1, In other words, the plurality of light members 17 may be provided as an individual light or a net of lights in series, i.e., suspended from the elongated tube structure 11. Referring to FIGS. 2A and 2B, the plurality of light members 17 coupled to the elongated tube structure 11 in several different ways is explained. Referring to FIG. 2A, a cross sectional view of the elongated tube structure 11 having a plurality of openings 18*a* is shown. The plurality of openings 18*a* may be preferably spaced at equal distances along the length of the elongated tube structure 11. However, the plurality of openings 18*a* may be spaced at varied distances along the length of the elongated tube structure 11. In the current example, each of the plurality of openings 18*a* may be provided with light member holding clips 19. Each of the clips 19 is coupled to the wire 16 to draw power. In order to couple the plurality of light members 17 to the elongated tube structure 11, the plurality of light members 17 may be slid up into the light member holding clips 19. In the current example, bumps (not shown) may be provided in the light member holding clips 19 in order to hold the plurality of light members 17 from falling down.

Now, referring to FIG. 2B, a cross-sectional view of the elongated tube structure 11 having a plurality of openings 18*b* is shown. The plurality of openings 18*b* may be preferably spaced at equal distances along the length of the elongated tube structure 11. However, the plurality of openings 18*b* may be spaced at varied distances along the length of the elongated tube structure 11. In the current example, each of the plurality of openings 18*b* may be provided with substantially U-shaped claws 20 into which the plurality of light members 17 may be inserted. The claws 20 may preferably have a left side 20*a* and a right side 20*b* made up of a flexible material so that light socket of the plurality of light members 17 may be inserted between the left side 20*a* and the right side 20*b* and thus held thereby. In order to couple the plurality of light members 17 to the elongated tube structure 11, the plurality of light members 17 may be glided up into the claws 20. Further, the plurality of light members 17 may be slid down in order to remove the plurality of light members 17 from the claws 20. Each of the claws 20 is coupled to the wire 16 to draw power. It should be understood that the plurality of light members 17 is secured to the elongated tube structure 11 without the need for clips 19 as shown in FIG. 2A.

Figure 3:
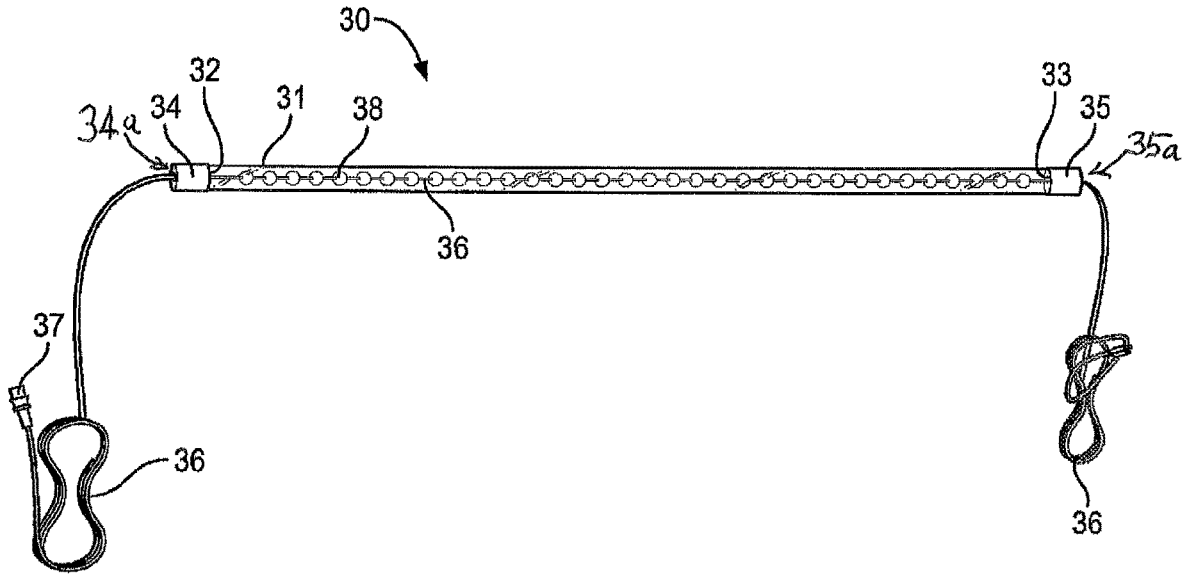
FIG. 3 illustrates an apparatus for suspending decorative lights wherein the decorative lights are inside a transparent elongated tube.

Referring to FIG. 3, an apparatus 30 for hanging decorative lights is shown. The apparatus 30 comprises an elongated tube structure 31. The elongated tube structure 31 may be made up of a flexible material. The elongated tube structure 31 comprises a first end 32 and a second end 33, in one example, the first end 32 is coupled to a first end cap 34 having a connector 34*a* therein. Further, the second end 33 is coupled to a second end cap 35 having a second connector 35*a* therein. In the current implementation, the elongated tube structure 31 comprises a wire 36 drawn through therein. Specifically, the wire 36 is drawn through the first end cap 34 and first connector 34*a*, an inner portion of the elongated tube structure 31, and through the second end cap 35 and second connector 35*a*. In one example, the wire 36 comprises a plug 37 that can be used to connect to a power source (not shown). In the current embodiment, the elongated tube structure 31 comprises lights 38 provided in series and coupled to the wire 36 in a series arrangement, as shown in FIG. 3. The lights 38 may be provided at an equal distance or at varied distance from each other. It should be understood that the elongated tube structure 31 is made using transparent material such that the lights 38 can be seen when electricity is provided through the power source.

Figure 4:
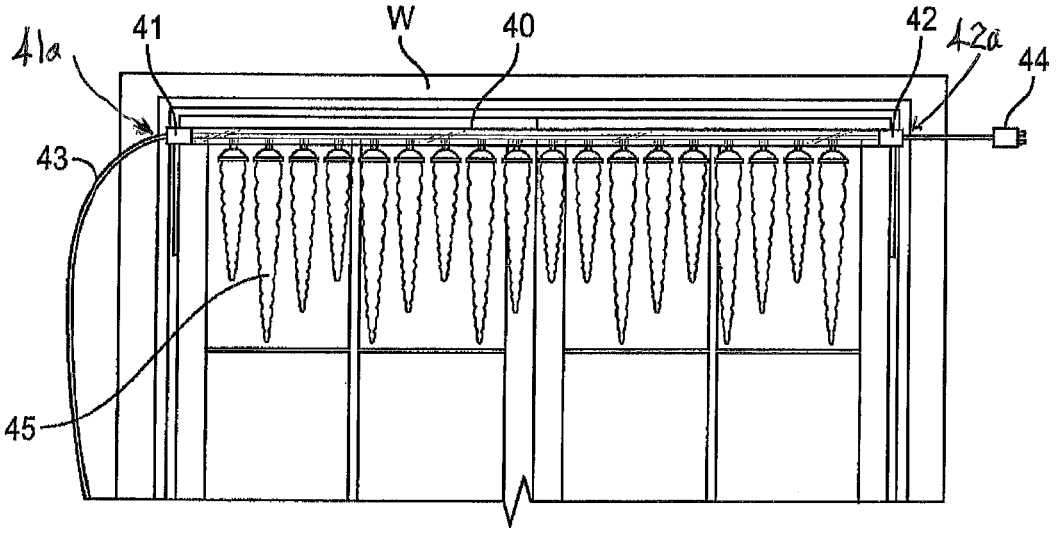
FIG. 4 illustrates an apparatus for suspending decorative lights, in accordance with one exemplary embodiment of the present disclosure.

As specified above, the elongated tube structure can be made up of a flexible material and can be connected to any structure at a building. Referring to FIG. 4, an elongated tube structure 40 provided at a window W is shown. Specifically, a user may place desired length of the elongated tube structure 40 to fit to the window W. The elongated tube structure 40 comprises a first end cap 41 having a connector 41*a* at one end and a second end cap 42 having a second connector 42*a* at another end. The elongated tube structure 40 comprises a wire 43 drawn through therein. In one example, one end of the wire 43 comprises a plug 44 which can be connected to a power source (not shown) to draw power or electricity. The wire 43 may be retractable into the inner surface of the elongated tube structure 40. Specifically, one end of the wire 43 comprising the plug 44 can only be pulled in one direction. On the other hand, the wire 43 may be pulled or refracted into the surface of the elongated tube structure 40 to desired length. The elongated tube structure 40 comprises a plurality of light members 45 suspending from bottom surface of the elongated tube structure 40. The plurality of light members 45 may be provided as a single light or in a net of lights as shown in FIG. 4. As explained above, the plurality of light members 45 is coupled to the elongated tube structure 40 in several different ways using clips or claws or any other known mechanisms. It should be understood that the current embodiment is presented to illustrate flexibility of the elongated tube structure 40 that can be shaped to connect to any shape in the building.

The elongated tube structure can be coupled to any structure due to its flexibility and the elongated tube structure can be molded to any shape. Further, the length of the elongated tube structure may be extended by connecting an additional elongated tube structure at the first or second connector provided at one end of the elongated tube structure. Further, openings or claws may be provided in the elongated tube structure to attach and detach the decorative lights. With the present disclosure, a user may replace a single bulb if it is found to be defective without much effort. Further, a user may have a single or multiple decorative lights in series in varied height, length, and width. Furthermore, a user may pack or unpack the decorative lights easily and can store without much difficulty.

In FIGS. 5-15, the elongated light tube 55 is connectable by a removable pivoting connector mount to a surface 52 extending in a plane parallel to an axis of said elongated light tube or the elongated light tube 60 is removably connected to a surface extending in a plane not parallel to an axis of said elongated light tube. For example, the elongated light tube 55 can be connected to a glass window pane, a solid door or other display planar surface, having a surface parallel to an axis of the elongated light tube. In another example, the elongated light tube 60 can be connected to a surface 51 by a connector mount not parallel to the axis of the elongated light tube, such as to vertically extending window frame walls 51 which extend typically outward perpendicular to an axis of the elongated light tube 60. In a further alternate embodiment, the elongated light tube 60 could be connected by a connector mount to a surface also not parallel to the axis of the light tube, but extending outward at a slanted angle less than the ninety degrees perpendicular plane of a window frame, door or other display surface, such as for example, to curved or slanted walls (not shown) extending less than ninety degrees outward from a glass window pane.

Figure 5:
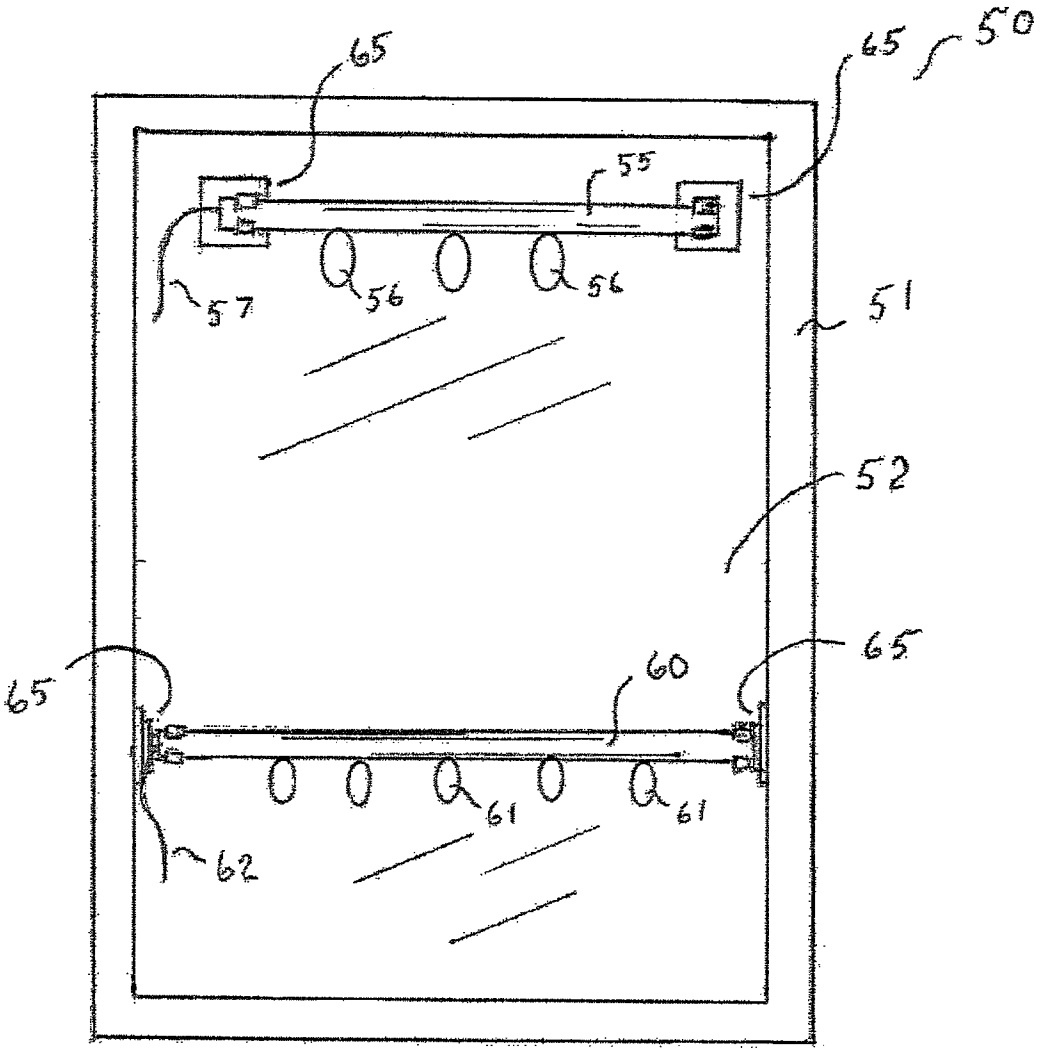
FIG. 5 shows a front view of a window with two elongated light tubes supported by mounts in two orientations.

For example, FIG. 5 shows window 50 with glass window pane 52 and frame 51. An elongated light tube 55 with lamps 56 and power cord 57 is attached to window pane 52 by one removable pivoting connector mount 65 near each end. The number of mounts can be as little as a single, centrally located mount, or a plurality of spaced apart mounts in excess of a pair of mounts shown in FIG. 5. As also shown in FIG. 5, further down window 50 is lighting tube 60 with lamps 61 and power cord 62. Lighting tube 60 is wider, reaching almost from frame 51 on the left to frame 51 on the right. It is attached to frame 51 using two removable pivoting connector mounts 65 (one on each window frame side) which are at a different orientation than the upper example.

Figure 6:
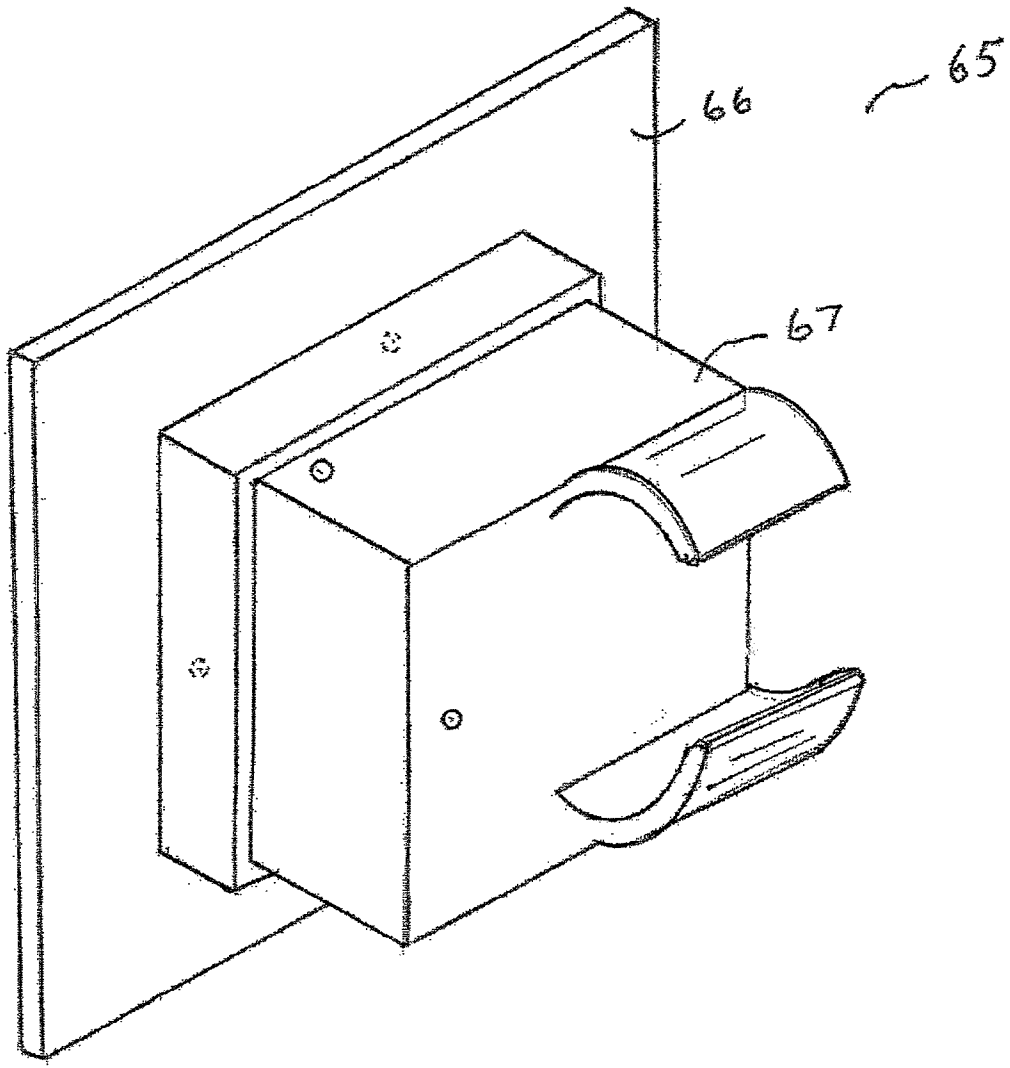
FIG. 6 is an enlarged perspective view of an assembled mount with a tube clip snapped into a mounting plate.

FIG. 6 shows an assembled removable pivoting connector mount 65 with the two parts engaged. Here tube clip 67 has been inserted (snapped-in) in mounting plate 66.

Figure 7:
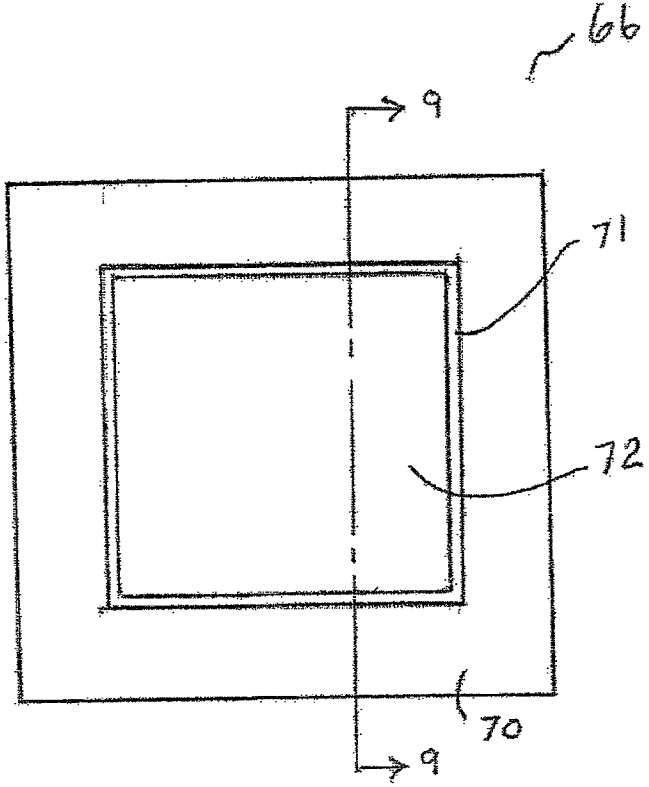
FIG. 7 is a plan view of a mounting plate.

FIG. 7 shows mounting plate 66 with low walls 71 on base plate 70 defining the perimeter of open box 72.

Figure 8:
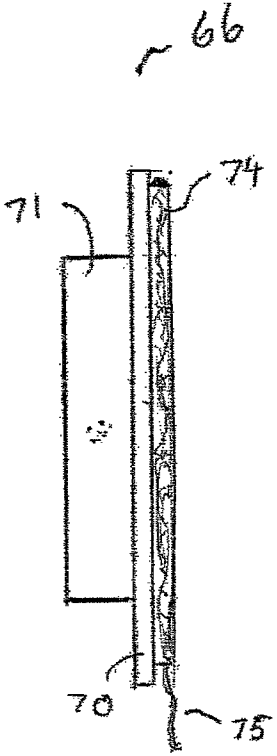
FIG. 8 is a side view of a mounting plate.

FIG. 8 is a side view of mounting plate 66 also showing a 3M COMMAND adhesive layer 74 with release tab 75 attached to the flat underside of base plate 70.

Figure 9:
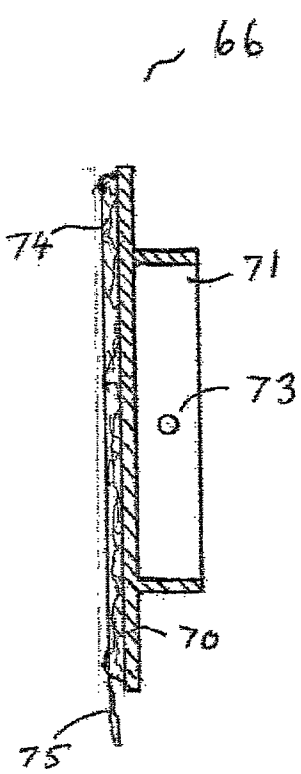
FIG. 9 is a cross sectional side view of a mounting plate.

FIG. 9 is a cross section view of removable pivoting connector mount plate 66. Note the round dimple 73 which is a latch feature used in these illustrations to retain tube clip 67 attached to mounting plate 66. Other types of retaining features such as edge latch members can be used.

Figure 10:
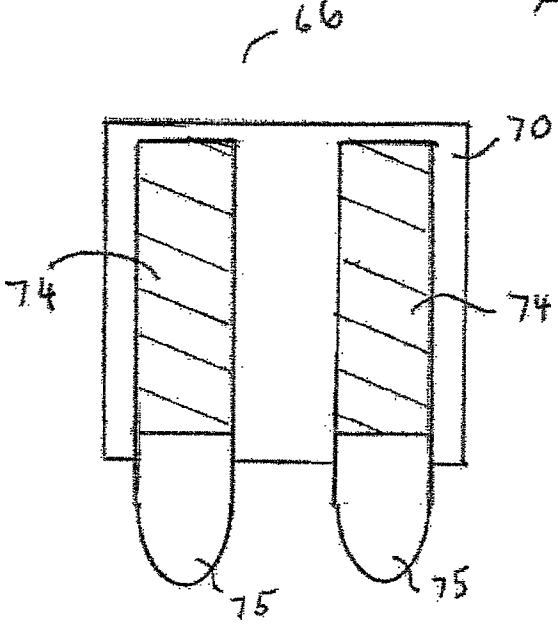
FIG. 10 is a back view of a mounting plate with two 3M COMMAND® mounting strips attached.

FIG. 10 shows the underside of mounting plate 66 with two 3M COMMAND® mounting strips 74 attached. 3M COMMAND® strips have very strong tensile and shear holding strength but low peel resistance which is induced by pulling on release tab 75, hence the clean, easy removal. As such, they are restricted as to length, width, and thickness ratios. In the current application for mounting light tubes, a pair of picture frame strips is workable.

Figure 11:
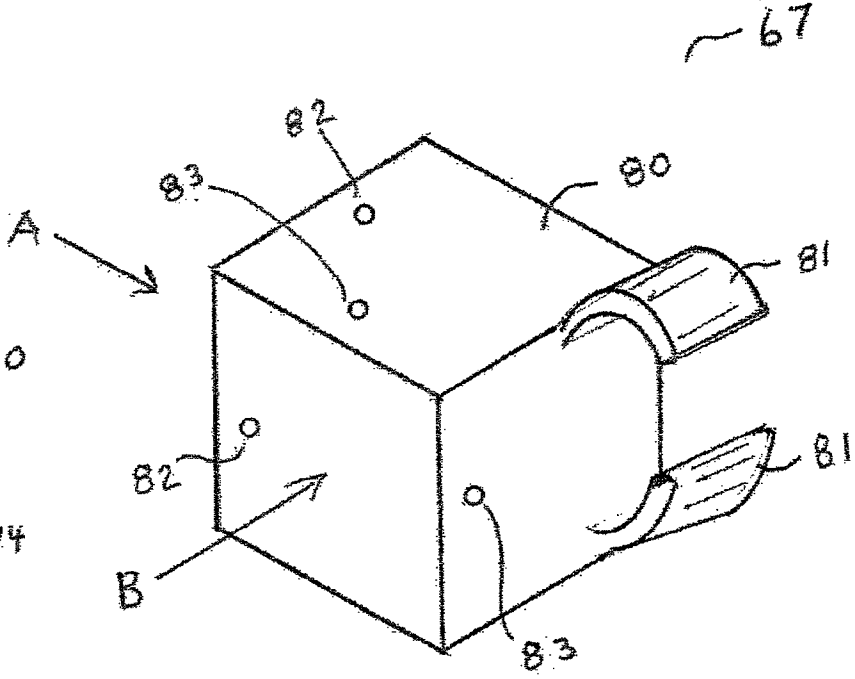
FIG. 11 is a perspective view of a tube clip.

FIG. 11 shows tube clip 67 with a cubic body 80 having spring clip arms 81 attached to grasp the outside diameter of a lighting tube. Low dome-shaped bumps 82 and 83 in strategic locations mate with round dimples 73 on the inside walls 71 of mounting plate 66. Two of the four bumps 82 are shown; these mate to create a mount 65 for use in holding lighting tube 55 in the proper orientation in FIG. 5 (engagement at face A). Two of the four bumps 83 are shown; they are used for holding lighting tube 60 when attaching to window frame 51 (engagement at face B). The orientation of mounts 65 can differ on both ends of a lighting tube. Also, depending on the strength of the grasp of arms 81, a single mount 65 may suffice to attach a lighting tube especially if grasped near the middle instead of one end. Note that an elongated lighting tube can be easily removed from mounts 65 and then returned without moving the mounts.

Figure 13:
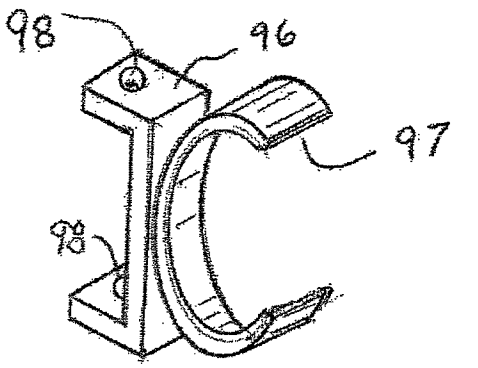
FIG. 13 is a perspective view of the tube clip of the second mounting embodiment.
Figure 12:
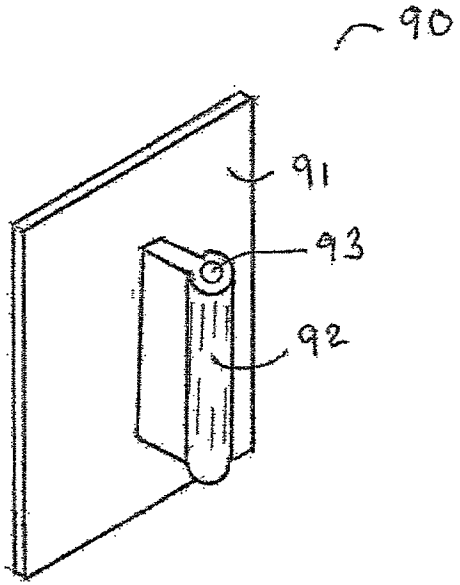
FIG. 12 is a perspective view of a second embodiment of a mount having a base plate with an attached extension having an extension with a pivot hole.
Figure 14:
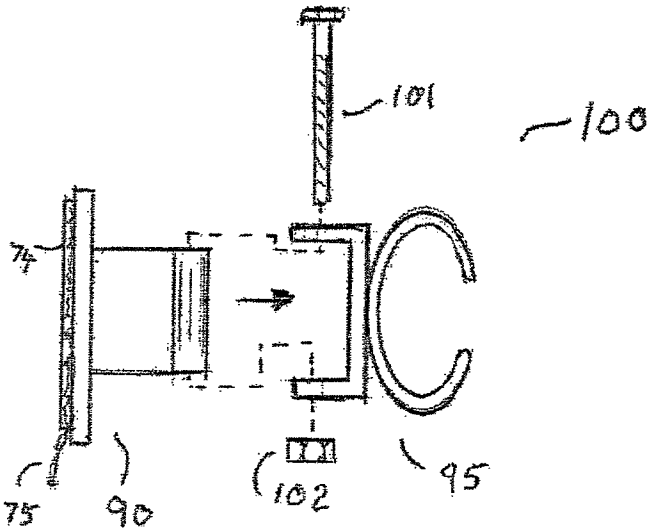
FIG. 14 is an exploded view of the second mounting embodiment of this invention including a bolt, which is the swivel axle, and a retaining nut.

FIGS. 12-15 show details of a second mounting embodiment of a mount with two pivoted parts. FIG. 12 shows removable pivoting connecting mounting plate 90 with base plate 91, and attached extension 92 with pivot hole 93 adjacent the distal end. FIG. 13 shows tube clip 95 with C-shaped spring clip 97 attached to bracket 96 which has pivot holes 98. FIG. 14 is an exploded view of removable pivoting connector mount 100 which is an assembly of mounting plate 90 and tube clip 95 joined together by bolt/axle 101 and retained with nut 102. It is noted that this second mounting embodiment also uses temporary adhesive strips, such as 3M COMMAND® adhesive strips 74, on the back side of base plate 91.

Figure 15:
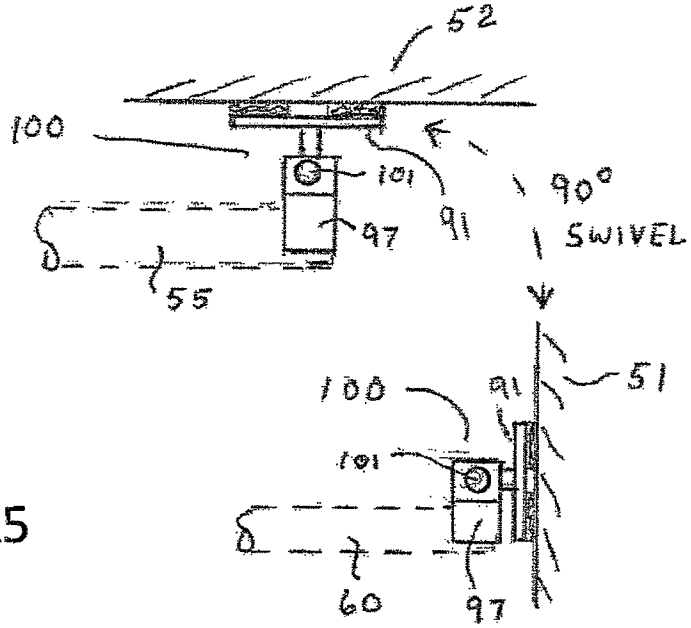
FIG. 15 is a top plan view of two mounts of the second mounting embodiment attached to two different supporting surfaces oriented 90 degrees apart from each other.

FIG. 15 shows two details of removable pivoting connector mounts 100 engaged in elongated light tube 55 and 60 (here shown in dashed phantom lines) from FIG. 5. These are top views looking straight down on the head of bolts 101. It is noted that supporting surface 52 is the glass window pane from FIG. 5 and supporting surface 51 is the window frame. It is noted also that spring clip 97 has not changed its orientation in the two detail views of FIG. 15, but base plate 91 has been rotated 90 degrees from the upper to the lower detail views. Once an elongated lighting tube is grasped by spring clip 97, it is prevented from further rotation.

The foregoing description conveys the best understanding of the objectives and advantages of the present invention, Different embodiments may be made of the inventive concept of this invention, it is to be understood that all matter disclosed herein is to be interpreted merely as illustrative, and not in a limiting sense.

I claim:

1. Apparatus for suspending lights comprising:

an elongated light tube having a removable connector at each end thereof to allow for extensions of said light tube;

an electric wire extending through said light tube and said connectors for connecting to adjacent light tubes and/or a power source;

a plurality of spaced openings formed along a length of said light tube;

light generating sources extending out of said spaced openings, each light source having a clip connecting to said electric wire for drawing power, said light sources being suspended from said light tube;

whereby said removable connectors are removable and said wire retracted into said light tube for storage;

said elongated light tube being connectable by at least one removable pivoting connector mount to a surface extending in a plane parallel to an axis of said elongated light tube or to a surface extending in a plane not parallel to an axis of said elongated light tube.

2. The apparatus of claim 1 in which said light tube is made from flexible material.

3. The apparatus of claim 1 in which connectors are threadably engaged to said light tube.

4. The apparatus of claim 1 in which each light source comprises a net or series of individual lights.

5. Apparatus for suspending display lights from a vertical surface comprising, in combination:

an elongated light tube having a removable connector at each end thereof to allow for extensions of said light tube;

an electric wire extending through said light tube and said connectors for connecting to adjacent light tubes and/or a power source;

a plurality of spaced openings formed along a length of said light tube;

light generating sources extending out of said spaced openings, each light source having a clip connecting to said electric wire for drawing power, said light sources being suspended from said light tube;

at least one removable pivoting connector mount attached to said light tube for adhesively connecting said light tube to said vertical surface; and whereby said at least one removable connector is removable and said wire retracted into said light tube for storage away from said vertical surface;

said elongated light tube being connectable by said at least one removable pivoting connector mount to said vertical surface, wherein said vertical surface is a surface extending in a plane parallel to an axis of said elongated light tube or wherein said vertical surface is a surface extending in a plane not parallel to an axis of said elongated light tube.

6. The combination of claim 5 in which said vertical surface is a transparent window of a building structure for viewing said display lights through said window.

7. The combination of claim 6 in which said window includes side frames, and said at least one removable pivoting connector mount is a plurality of removable pivoting connector mount s mounts being adhesively attached to said side frames.

8. The combination of claim 5 in which said at least one removable pivoting connector mount comprises a mounting plate with an adhesive layer on a surface of said mounting plate attached to said vertical surface, wall members mounted on an opposite side of said mounting plate forming an open box, a cubic body press fit into said open box, said cubic body having a flat surface opposite that of said open box having spring clip arms for grasping said light tube, thereby securing said light tube on said vertical surface extending in a plane parallel or an axis of said elongated light tube or onto said vertical surface extending in a plane not parallel to said axis of said elongated light tube.

9. The combination of claim 8 wherein said vertical surface extends perpendicular to said axis of said elongated light tube.

10. The combination of claim 8 wherein said vertical surface extends at a slanted angle to said axis of said elongated light tube.

11. The combination of claim 8 in which said adhesive on said mounting plate comprises one or more mounting strips having release tabs for easy removal of said mount from said window vertical surface.

12. The combination of claim 5 in which said at least one removable pivoting connector mount comprises a mount with two pivoting parts.

13. The combination of claim 12 further said at least one removable pivoting connector mount comprising a mounting plate with a base plate, and an attached extension with a pivot hole adjacent the distal end; a tube clip with a C-shaped spring clip being attached to a bracket having reciprocal pivot holes, wherein the mounting plate and tube clip are joined together by a bolt/axle and retained by a retainer.

14. The combination of claim 13 in which each said at least one removable pivoting connector mount comprises a mounting plate with an adhesive layer on a surface of said mounting plate attached to said vertical surface.

15. The combination of claim 14 in which said adhesive on said mounting plate comprises one or more mounting strips having release tabs for easy removal of said at least one removable pivoting connector mount from said vertical surface.

16. A method of constructing and using a light tube for displaying lights comprising the steps of:

providing an elongated light tube having a removable connector at each end thereof to allow for extensions of said light tube;

extending an electric wire through said light tube and using said connectors to connect said electric wire to adjacent light tubes and/or a power source;

providing a plurality of spaced openings along a length of said light tube;

suspending light generating extending sources out of said spaced openings, using a clip to connect each light source to said electric wire for drawing power, said light sources thereby being suspended from said light tube;

using one or more removable pivoting connector mounts attached to said light tube for adhesively connecting said light tube to said vertical surface;

connecting said elongated light tube by said one or more removable pivoting connector mounts to said vertical surface, wherein said vertical surface is a surface extending in a plane parallel to an axis of said elongated light tube or wherein said vertical surface is a surface extending in a plane not parallel to an axis of said elongated light tube; said removable pivoting connector mount having at least one removable adhesive layer strip; and removing said one or more removable pivoting connector mounts from said vertical surface and said connectors from ends of said light tube, followed by retracting said wire into said light tube for storage away from said vertical surface.

17. The method of claim 16 in which said vertical surface is a transparent window of a building structure for viewing said display lights through said window.

18. The method of claim 16 in which said window includes side frames, and said one or more removable pivoting connector mounts are adhesively attached to vertical surfaces of said side frames.

19. The method of claim 16 in which each said removable pivoting connector mount comprises a mounting plate with an adhesive layer on a surface of mounting plate attached to said vertical surface, wall members mounted on an opposite side of said mounting plate forming an open box, press fitting a cubic body into said open box, said cubic body having a flat surface opposite that of said open box having spring clip arms, and using said spring clip arms for grasping and supporting said light tube on said window vertical surface.

20. The method of claim 16 in which each said removable pivoting connector mount comprises a mount with two pivoting parts, capable of mounting said elongated light tube to at least one of a vertical surface extending parallel to an axis of said elongated light tube or to a vertical surface not extending parallel to an axis of said elongated light tube.

* * * * *